United States Patent [19]

Anderson

[11] 4,452,021

[45] Jun. 5, 1984

[54] NATURAL WOOD SUSPENDED WOOD CEILING OR WALL SYSTEM EMPLOYING CLIP MEANS

[75] Inventor: James W. Anderson, Mound, Minn.

[73] Assignee: Construction Concepts, Inc., Mound, Minn.

[21] Appl. No.: 346,085

[22] Filed: Feb. 5, 1982

[51] Int. Cl.[3] ..... E04C 2/38

[52] U.S. Cl. ..... 52/311; 52/484; 52/717

[58] Field of Search ..... 52/DIG. 8, 484, 717, 52/716, 311, 312, 489, 39

[56] References Cited

U.S. PATENT DOCUMENTS

| | | | |
|---|---|---|---|
| 3,342,006 | 9/1967 | Joseph et al. | 52/DIG. 8 X |
| 3,557,506 | 1/1971 | Pechenik | 52/309.4 |
| 3,594,972 | 7/1971 | Jones et al. | 52/311 |
| 3,936,990 | 2/1976 | Garrison, Jr. | 52/717 |
| 4,055,930 | 11/1977 | Weiner et al. | 52/717 |
| 4,189,888 | 2/1980 | Blitzer, Jr. | 52/484 |
| 4,361,996 | 12/1982 | Smith | 52/484 |
| 4,370,373 | 1/1983 | Janicz | 52/717 X |

FOREIGN PATENT DOCUMENTS

| | | | |
|---|---|---|---|
| 2823036 | 11/1979 | Fed. Rep. of Germany | 52/489 |

*Primary Examiner*—Carl D. Friedman

*Attorney, Agent, or Firm*—Orrin M. Haugen; Thomas J. Nikolai; Douglas L. Tschida

[57] ABSTRACT

A suspended ceiling system or wall system employing clip means for coupling a decorative molding system thereto, that, in turn, supports a decorative plaque system. The preferred clip means is fabricated to permit the semi-permanent attachment of individual clips to a suspended grid TEE system and contains a clip leg with extruded wands angling therefrom for frictionally coupling decorative molding thereto. Alternative clip means are also disclosed wherein various forms of spring and/or dove-tail coupling are employed for affixing the clips to the grid TEE system and the molding system.

4 Claims, 11 Drawing Figures

NATURAL WOOD SUSPENDED WOOD CEILING OR WALL SYSTEM EMPLOYING CLIP MEANS

BACKGROUND OF THE INVENTION

The present invention relates to suspended ceiling systems or wall systems and, in particular, to a decorative system wherein a molding system is coupled to a suspended grid TEE system and which, in turn, supports a decorative plaque or panel system.

Lay-in ceiling systems have been known for many years and can be found in many types and styles. The most common of these employ a suspended grid TEE system that supports lay-in panels that are placed between the grid TEE members or tongue and grooved panels that interlock with one another and the grid TEE system, via the grooved edges of the panels.

The panels for such systems are typically fabricated from a fire rated substrate material that may or may not have acoustic deadening properties and upon one of which exposed surfaces a design is formed, either by molding the design from the substrate material or by attaching a thin laminant containing the design to the substrate material. The panels for such systems may also have their edges rabbit cut so that the decorative surfaces lie slightly below for grid TEE system, thereby causing the grid TEE system to appear recessed with respect to the lay in panels, reference U.S. Pat. No. 3,153,304.

Systems of the above type, while offering a great deal of versatility, when accomodating lighting and other mechanical apparatus that are suspended above the ceiling, suffer from the limited numbers of appearances that can be created thereby. While natural wood/-molded plaque systems have been used for creating a richer appearance and adding texture to a room, such systems have proven to be relatively expensive in that they are labor intensive with respect to the mounting thereof.

In such natural wood/molded plaque systems, the lay-in panels or plaques are most typically fabricated from a substrate material to which a thin layer of a natural wood veneer is attached and which veneer may also have a molded wood design glued thereto. Such natural wood plaques or panels are then suspended above and within a grid of wood moldings that are attached to the grid TEE system so as to form a continuous molding/plague ceiling or wall system having a rich natural wood appearance. Such systems, however, suffer from difficulties in attaching the molding to the grid TEE systems, in that, to date, attachment has been achieved only via individually screwing or stapling the molding to the main TEE's and cross TEE's of the grid system. Such a method of attachment is extremely labor intensive, and thus increases the cost of such a ceiling or wall system.

It is therefore a primary object of the present invention to enable the assembly of decorative ceiling and wall systems in a minimum amount of time without the expenditure of a great deal of labor.

It is a further object to accomodate a suspended ceiling system that is compatible with the presently known and most common suspended grid TEE ceiling systems.

It is a still further object to produce a ceiling or wall system wherein the decorative molding is attached to the supporting grid system via clip means that are formed so as to be adaptively comparable with the molding and create a secure mechanical bond upon coupling the clip to the molding.

It is also an object to create a clip means from a relatively inexpensive resilient material containing memory properties so as to enable a spring type clip action to the grid system.

It is a further object to employ a clip leg having extruded wands angling therefrom for making a secure mechanical attachment to the molding, upon inserting the clip leg into a recess adaptively formed in the molding.

It is still another object of the present invention to consider alternative clip means employing various combinations of spring and dovetail coupling actions with respect to the grid and molding systems.

These objects and still others will become more apparent upon a reading of the following detailed description and upon reference to the following figures. It is also to be recognized, that the following description and drawings disclose concepts which may be broadly applied to numerous others types of other decorative ceiling and wall systems.

SUMMARY OF THE INVENTION

A decorative ceiling or wall system employing clip means for attachably mounting a molding system to a grid system, the ceiling or wall. The molding system, in turn, supports a plurality of decorative plaques. The preferred ceiling and wall systems are comprised of molding members that are formed from natural wood and wherein the lay-in panels or plaques have a natural wood surface that may or may not contain additional molding.

The preferred embodiment of the clip means is adaptively formed for attachment to a grid TEE system, via a clip ear and an elongated clip tongue. The clip means further contains a clip leg having extruded wands angling therefrom so as to make a frictional attachment with the molding, upon inserting the clip leg within a compatable recess formed within the molding.

Alternative clip means are also disclosed, wherein the clip ear contains an additional tongue so as to permit the disassembly of the clip means from the grid system. Also disclosed are clip means that are formed so as to create a dovetail holding action between the clip and the molding system and/or having clip ears and clip springs for securely attaching the clip means to the grid system. Further, clip means are disclosed for enabling the assembly of molding/plaque wall systems.

DESCRIPTION OF THE PREFERRED EMBODIMENT

Figure 1:
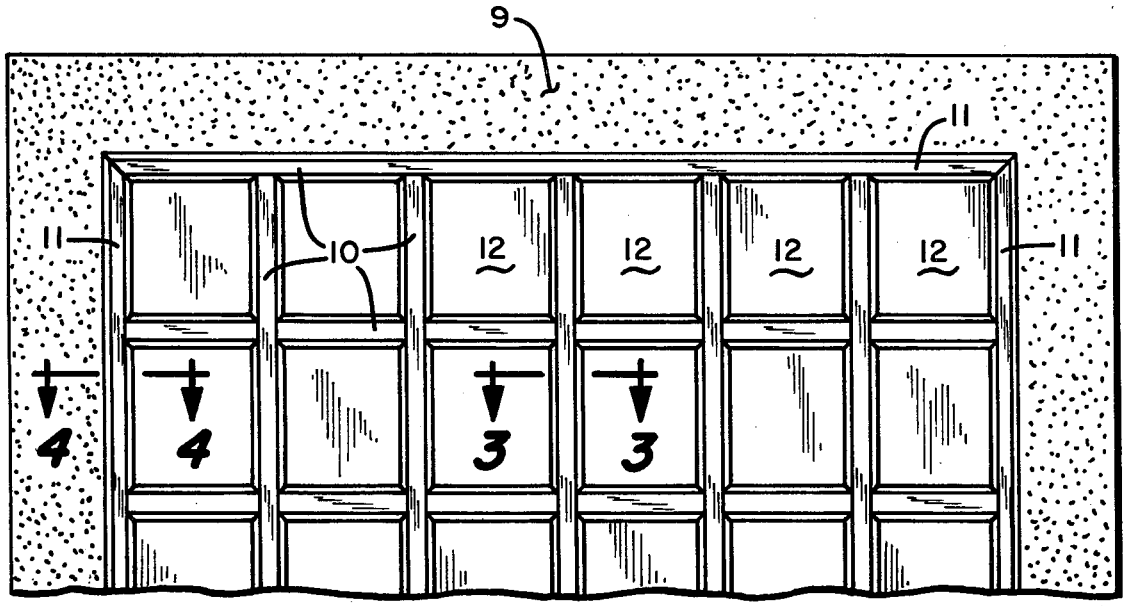
FIG. 1 is a cutaway, two dimensional view, looking up, of a natural wood suspended ceiling system, employing a molding system that has been affixed to an overlying grid TEE system via clip means.

Referring to FIG. 1, a two dimensional cutaway view is shown, looking up, at a suspended grid TEE ceiling system. The system employs a plurality of moldings 10 that are attachably coupled to the hidden grid TEE system (i.e. the main and cross-TEE's thereof). While the molding 10, in the preferred embodiment, is fabricated from a natural wood such as oak, birch, walnut, etc., it is to be recognized that the molding 10 may also be formed from a decorative plastic material. The molding 10 may also be routered or otherwise machine so as to display any type of decorative surface that may be desired.

While more than one style or pattern of molding 10 may be employed in a ceiling system, typically the molding is coupled in the grid TEE system to form a lattice or matrix configuration coincident with the suspended grid TEE system. The moldings 10, as mentioned, are individually affixed to the suspended grid TEE system. The manner of attachment may vary, as will be discussed in detail hereinafter, but generally the main or longest sections of molding 10 are run contra to the grid system and are affixed to the individual cross-TEE members, in lieu of the main TEE members, so as to provide a more rigid ceiling system.

Thus, assuming that the main sections of molding 10 are coupled to the cross-TEEs, it is necessary that the individual sections of cross molding abut with the main molding runs. The method and manner of abuttment may take many forms, the easiest, however, is to router the ends of the cross molding so as to be compatable with and overlap the main runs of molding. Another method is to use cross-over caps, so that upon assembly, it is only necessary to bring the individual cross moldings into close proximity to the main runs of molding and after which a cap may be placed thereover to hide the manner of the intersection of the molding. Such a cap also adds yet another dimension of depth and decorativeness to the ceiling. Still too, in-line caps may be fabricated so that the extensions thereof can be aligned with each of the molding runs, as by nylon keys that are inserted into aligning slots that are formed in the backs of the molding 10. Such a cap would produce a slight seam but which seam would not be too noticeable to an observer on the floor below.

Depending upon the ceiling, edge molding 11 may also be required. Such a molding 11, when used, can be coupled to the grid system, right angle edge molding, and which is typically affixed to the wall. Alternatively, the edge molding 11 can directly abut and be attached to the soffit or border 9, or the edge molding 11 can be coupled to the grid system in the manner of FIG. 4, but which will be described in greater detail hereinafter.

It is also to be recognized that once the molding system has been attached to the suspended grid TEE system, it is only necessary to individually lay in the decorative plaques 12. The plaques 12, like the molding 10, may be fabricated in any number of varities of decorative surfaces. For purposes of the preferred embodiment, however, it is contemplated that the decorative plaques 12 would typically have a natural wood veneer surface, to which additional molding would be attached, as desired, or wherein the individual plaques 12 would have routered designs let into the surfaces thereof.

Thus, it should be readily apparent that the ceiling system of FIG. 1 represents merely one style and type of decorative ceiling system that may be assembled. Further, it is to be recognized that such a system may also be affixed to a wall, as well as the ceiling, upon attaching compatable clips thereto, so as to create a unique decorative wall system.

As previously mentioned, decorative ceiling and wall systems having an appearance similar to that of FIG. 1 have been assembled via the direct attachment of the molding to the grid TEE system via screws and staples. The present invention, however, contemplates the use of an extruded clip of the type generally shown in FIG. 2.

Figure 2:
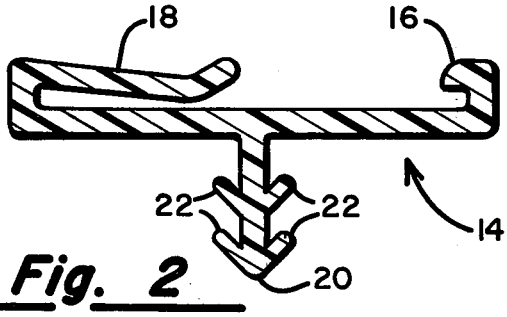
FIG. 2 shows a detailed cross-sectional view of the preferred splined clip means.

Upon reference to FIG. 2, a cross sectional view is shown of the preferred embodiment of a splined clip 14. While shown in cross section, it is to be noted that the splined clip 14 is typically fabricated via a plastic extrusion process from a polyvinyl chloride (PVC) material that is subsequently cut so as to produce clips of approximately 4 to 6 inches in length or of any other desired length, depending upon the application. The splined clips are then displaced along the suspended grid TEE system at approximately uniform increments (i.e. 18 to 36 inches) so as to ensure that the molding 10 will be properly supported along the suspended grid TEE system.

Referring to FIG. 2, it is to be noted that the splined clip 14 is fabricated so as to possess a clip ear 16, that is formed to overlap one rail edge of a suspended grid TEE member, and an elongated clip tongue 18, that overlaps the other rail edge of the suspended grid TEE member, thereby securing the splined clip 14 to a suspended grid TEE member. The spacing from side to side of the splined clip 14 may be adjusted during fabrication, depending upon the width of the grid TEE members, but in general the ear 16 and tongue 18 are designed so as to be containably mounted around the lower rails of the suspended grid TEE members. Because the splined clip 14 is fabricated from a PVC type material, and which material may be resiliently displaced from a normal shape and spring back to the normal shape upon removal of the displacing force, the tongue 18 may be bent upwards and backwards, upon looping the ear 16 about one rail edge of the suspended grid TEE member, so as to permit the other rail edge to be placed within the recess formed between the tongue 18, ear 16 and body 19 of the splined clip 14, thereby containing the grid TEE member upon releasing the tongue 18. Thus, it is a simple matter to attach the necessary splined clips 14 to a suspended grid TEE system at the proper spacing.

Upon so attaching the splined clips 14, it is to be noted that the spline or clip leg 20 is formed so as to extend orthogonal to the lower surface of the clip body 19 and grid TEE system. Attached to and formed as a part of the clip leg 20, on opposite sides thereof, are individual wands 22 that are formed from a soft PVC material and which extend angularly from the clip leg 20, upwards and away from the leg 20. It is to noted that the extruded wands 22 are typically formed in a symmetrical fashion with one wand directly opposite the other on the clip leg 20 and each having the same mounting angle. However, it may in some instances be desirable to change the angle and the placement of the wands 22, as well as to make the wands 22 more bristle like as they extend along the clip leg 20. The intent, however, is to fabricate the wands 22 so that upon inserting the clip leg 20 into a kerf or dado cut in the unexposed surface of the molding 10, the wands 22 will bend slightly so as to frictionally secure the molding to the splined clip 14. Therefore, rubber or any other number of materials may also be used for the wands 22, but at present the soft PVC is most compatible with the process for making the splined clips 14.

Further, it has been found that the frictional force of the wands 22 against the sides of the kerfs in the moldings 10 virtually makes it impossible to pull the moldings 10 away from the splined clips 14. It is to be recognized though that this frictional force can be adjusted via adjusting the lengths of the wands 22, the material thereof or the width of the kerf in the molding 10. Typically, the kerf is cut slightly smaller than the tip to tip width between oppositly displaced wands 22. Thus, the clip ear 16 and clip tongue 18 resiliently contain the splined clip 14 about a suspended grid TEE member and the clip leg 20 and wands 22 resiliently contain the molding 10 to the splined clip 14. Also, it is to be noted that the depth of the kerf may be adjusted, as desired, to provide stress relief to the molding 10, and thereby prevent or minimize the warping of the molding 10.

Figure 3:
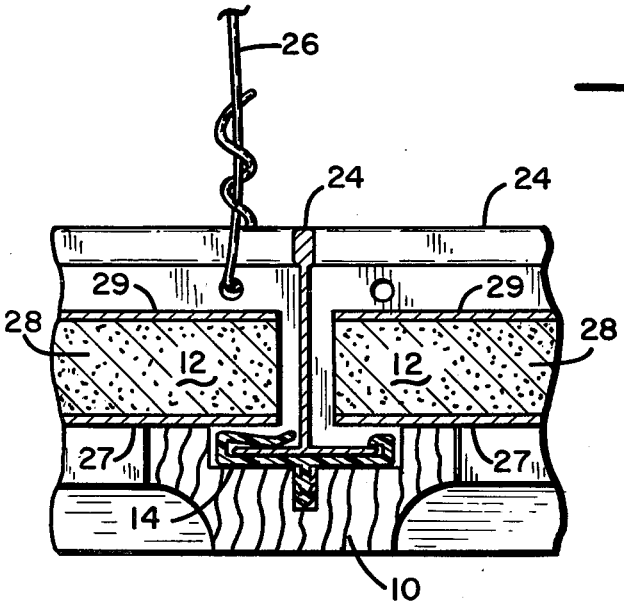
FIG. 3, taken along lines 3—3 of FIG. 1, shows a detailed cross-sectional view of the splined clip means in conjunction with the molding system and lay in panels in the ceiling system.
Figure 4:
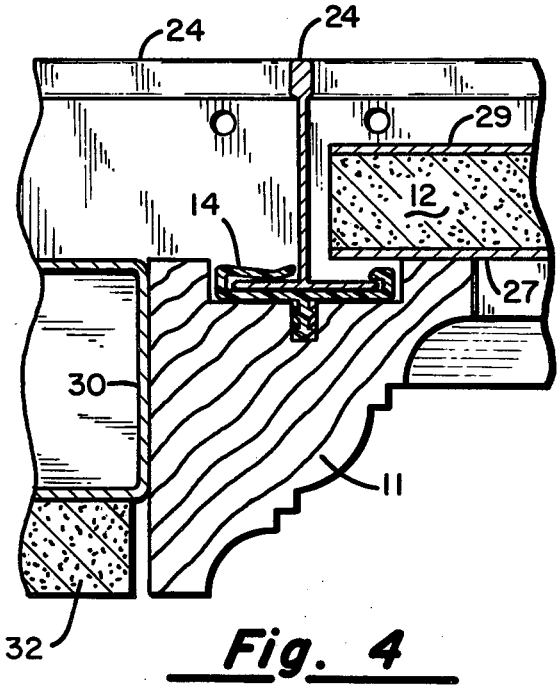
FIG. 4, taken along lines 4—4 of FIG. 1, shows a detailed cross-sectional view of an edge molding in conjunction with the clip means.

Attention is now directed to FIGS. 3 and 4 wherein the above referenced clip attachment can be more clearly seen with respect to the cross-sectional views along lines 3—3 and 4—4 of FIG. 1. With reference to FIG. 3, it is to be noted that the grid TEE members 24 are shown relative to the wire 26 by which the grid TEE system is suspended from the ceiling. The level and drop to the system is adjusted by the length of the wire 26. Recognizing too that FIG. 3 represents a grid intersection point, it is to be noted that one of the grid TEE members 24 is a main TEE and the other is a cross TEE. FIG. 3 thus shows the relative relationships of the suspended grid TEE system, the molding 10 and the splined clips 14 to one another.

From FIG. 3, the lay-in plagues 12 are also shown in greater detail. In particular, the plaques 12 have a thin wood veneer 27 glued to the lower surface of a substrate 28, as well as a backing 29 that is glued to the substrate 28 on the upper surface thereof and which is not seen during use. Such a backing material is typically formed from a particle board or fiber board or any other suitable material that is relatively rigid so as to prevent the warping of the plaque 12 when the facing material or veneer 27 is applied to the substrate 28.

The wood veneer 27 is typically bonded to the substrate 28 via a dry adhesive method that employs heat and pressure. Such a method prevents undesirable moisture from causing warping, during bonding and the backing 29 ensures that warping does not occur during the period of extended use.

As mentioned, the substrate material also typically possesses a fire rating and which rating is not degraded due to the addition of the wood veneer 27. Also, the use of the thin wood veneer 27 can provide additional acoustic absorbing qualities, due to diaphramatic dampending, as where the veneer 27 is placed over a substrate 28 comprised of a fiber glass material or a substrate 28 having a plurality of voids or hollows formed therein.

Upon reference to FIG. 4, the edge molding 11 of FIG. 11 can be seen more clearly, as it is employed with respect to a ceiling having a soffit or border 9 that surrounds the wood molding/plaque system. Thus, from FIG. 4, and which shows a ceiling with a metal furring channel 30 such as where the suspended ceiling extends between two rooms, the edge molding 11 abuts against a furring channel 30 that, in turn, supports a piece of sheet rock 32 which is affixed to its lower surface. Further, a $\frac{1}{8}$ inch reveal gap is provided between the edge molding 11 and the edge of the sheetrock. The reveal gap produces a shadowing effect to the observer and hides the interface between the edge molding 11 and the sheetrock 32. It is to be recognized that, alternatively, standard right angle edge molding or even the edge molding 11 alone, could be employed by affixing the right angle edge molding to the wall and the edge molding 11 to it. Additionally, a grid TEE member 24 may suspended near the edge of the border 9 so that the edge molding 11 can be attached to the splined clip 14 in the same manner as for the rums of the molding 10.

Figure 5:
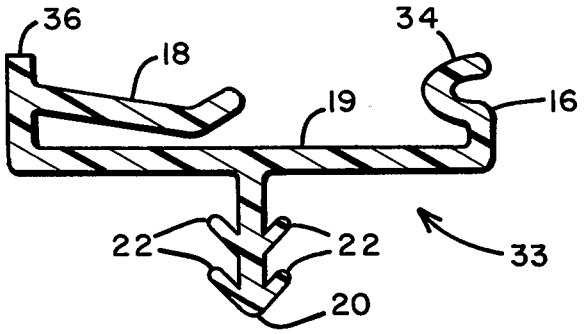
FIG. 5 is an alternative embodiment of the clip means of FIG. 2, wherein the clip ear contains a clip tongue for facillating the detachment of the clip means from the grid system.

Referring next to FIG. 5, a modified splined clip 33 is shown in cross section and wherein the clip ear 16 is formed so as to contain an additional clip tongue 34 and by which a grid TEE member 24 may be more easily removed from the splined clip 33. Such removal would most typically be achieved by removing an adjacent lay-in panel so as to permit an operator to depress the clip tongue 34 while twisting the grid TEE member 24, in the opposite direction, so as to permit the grid TEE member 24 to be removed from beneath the clip tongue 18. Such a disassembly operation can also be achieved via a bent tool that permits the operator to grab the clip ear 34 and pull it away from the grid member 24, either by direct force or via leverage with respect to grid TEE member 24. The embodiment of FIG. 5 also contains a slightly raised portion 36 along the extreme left edge of the clip tongue 18 that provides additional strength to the clip tongue 18.

Figure 6B:
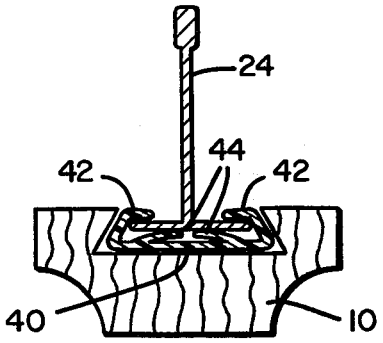
FIG. 6b shows a cross-sectional view of the clip means of FIG. 6a, and the spring/dovetail coupling action to the grid TEE and molding systems.
Figure 6A:
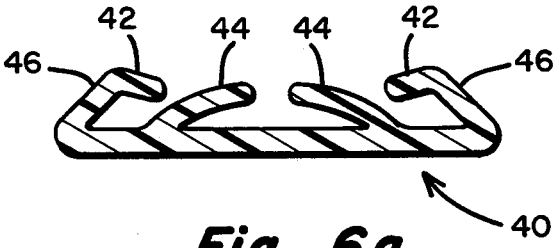
FIG. 6a, shows another alternative clip means employing a separate spring element for securing the clip means to the grid TEE system.

Next referring to FIGS. 6*a* and 6*b* and, in particular, referring in FIG. 6*a*, yet another clip means is shown. The clip 40 is again formed from an extruded PVC material so as to exhibit a combination spring/dovetail coupling action with a grid TEE member 24 and molding 10. In particular, clip ears 42 are provided on each side of the clip 40 so as to permit an attachment similar to that for splined clip 14 to the lower rail of the grid TEE member 24. Also, included are spring members 44 that extend from the lower surface of the clip 40 inwardly and at an angle thereto and that maintain tension, upon mounting the clip 40 over the rail of the grid TEE member 24.

From FIG. 6*b* and after attachment of the clip means 40 to the grid TEE member 24, it can be seen that the clip 40 is affixed to the grid TEE member 24 due to the opposing forces from the clip ears 42 and the spring elements 44, respectively in a downward and upward direction relative to the flat lower rail of the grid TEE member 24. Further, the clip 40 of FIGS. 6*a* and 6*b* is formed so that angular dovetail edges 46 are formed and by which the clip is retained within a similarly formed dovetailed recess in the molding 10, as seen in FIG. 6*b*.

Figure 7:
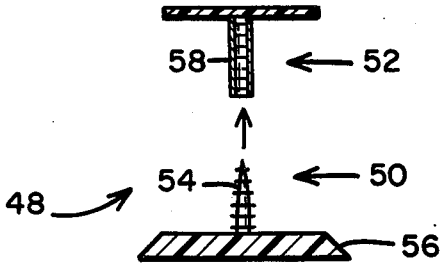
FIG. 7 shows a cross-sectional view of an alternative dovetail wall clip means having a mechanical fastener attached to one side thereof and formed so as to permit a dovetail action with the molding.

Referring to FIG. 7, a composite dovetail wall clip 48 can be seen with respect to its two halves 50 and 52. Such a clip is formed by intermittently embedding the fasteners 54 (i.e. screws or other suitable mechanical fasteners) into a solid, extruded dovetail element 56 having angulated edges and which edges match a similarily formed recess within the molding 10. Upon slipping the dovetailed portion 56 of the clip 48 into the recess of a molding 10, the fasteners 54 are then aligned relative to the receiving fasteners 52 so that the threaded or ringed fingers on the fasteners 54 will be engaged within the barrels 58. It is to be recognized that the clips 48 are best employed for wall systems wherein the permanently affixed receiving fasteners 52 are glued, stapled or otherwise attached to the wall. It is also to be recognized that for wall systems, the plaques 12 are inserted as the wall's molding system is assembled and that such systems are relatively permanent, when compared to ceiling systems, since the plaques 12 and molding 10 are not as easily removed after the edge molding 11.

Figure 8:
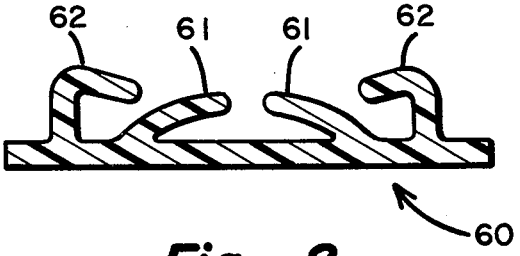
FIG. 8 shows a cross-sectional view of a square flanged clip means employing a separate spring element for securing the clip means to the grid TEE system and having a flange for coupling to a cooperative recess formed in the molding.
Figure 9:
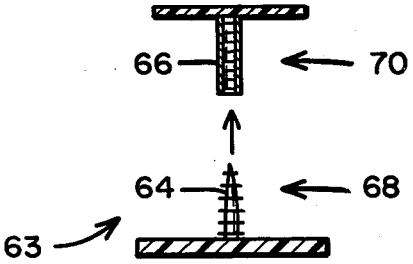
FIG. 9 shows a cross sectional view of a square flanged wall clip means having a mechanical fastener attached to one side thereof for containing molding having a similarily formed recess.

FIGS. 8 and 9 similarily disclose square flanged ceiling and wall clips 60 and 63 that are formed for insersion into matching recesses formed in the molding 10. The clip 60 of FIG. 8, like clip 40 contains spring members 61 and clip ears 62 for attaching the clip 60 to the grid member 24. So too, the clip 63 of FIG. 9 contains a fastener 64 that is inserted into the barrel assembly 66 of the receiving fastener 70, after the square flanged portion 68 of the clip has been inserted into the matching recess of the molding 10. The receiving fastener 70 is again permanently attached to the wall.

Figure 10:
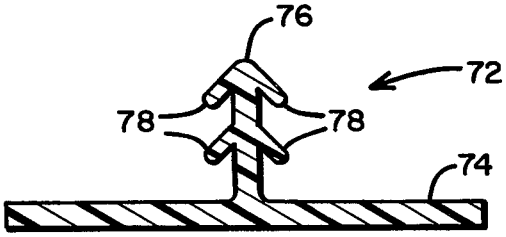
FIG. 10 shows a cross-sectional view of a splined clip means having a clip leg and wands for a wall system.

Finally, upon reference to FIG. 10, yet another modified splined clip 72 employing the teachings of FIGS. 2, 7 and 9 is shown, wherein an extruded splined clip 72 is formed with a body member 74 having a splined leg 76 and wands 78 so that the body member 74 may be glued or permanently attached to a wall or other surface, while the spline 76 is frictionally attached within the kerf of a molding 10. Its also to be noted that the splined clip 72 can be slidably mounted within a metal channel that is affixed to the wall so as to provide some adjustment in the clip placement and/or the molding 10, after it has been attached to the splined clip 72.

While the present decorative ceiling and wall systems have been described with respect to a number of alternative embodiments, it is to be recognized that upon a reading hereof by one skilled in the art, yet still others embodiments may be suggested. Accordingly, it is contemplated that the following claims will be interpreted broadly so as to encompass any such equivalent structures.

What is claimed is:

1. A clip for coupling a molding element to a T-shaped support member comprising:

a body member formed to be received within a recess formed within said molding element;

first and second projections extending from said body member for mounting about the side edges of an exposed face of said support member; and third and fourth resilient projections extending upwardly from said body member so as to compressively contain the exposed face of said support member between said first and second projections and said third and fourth projections, thereby securing said clip and molding element to said support member.

2. In a ceiling or wall system having a plurality of support members mounted relative to one another so as to form a multi-sectioned grid and within which sections a plurality of ceiling panels are supported, a plurality of clips for coupling a plurality of molding members to the exposed faces of said support members, each of said clips comprising:

an elongated body member having a first projection extending from one of the lateral edges of said body member and a second projection extending from the other edge, said first projection fixedly mountable about a first side edge of said support members and said second projection flexibly mountable about a second side edge of said support members for releasably containing said body member to the otherwise exposed surface of said support members; and a spline extending from said body member and having a plurality of resilient wands affixed to and longitudinally coextensive with each side of said spline for insertion into a recess formed in said molding members, whereby said wands frictionally secure said molding members to said support members.

3. A system as set forth in claim 2 wherein each of said clips include a member acutely outwardly projecting from one or the other of said first or second projections, whereby a flexive force may be applied to said acute member for rotatively releasing the associated projection and thereby said clip from said support member.

4. A system as set forth in claim 2 wherein said wands of said clip are acutely upwardly directed from said spline towards said body member, whereby said spline and wands are easily inserted into the recess of said molding member and removed only with relatively greater difficulty.

* * * * *